United States Patent [19]

Westergren

[11] Patent Number: 4,738,697

[45] Date of Patent: Apr. 19, 1988

[54] VACUUM CLEANER BAG MOUNT AND METHOD FOR MOUNTING A DUST BAG THEREON

[75] Inventor: George A. Westergren, Linwood Township, Anoka County, Minn.

[73] Assignee: Whirlpool Corporation, Benton Harbor, Mich.

[21] Appl. No.: 939,760

[22] Filed: Dec. 9, 1986

[51] Int. Cl.[4] ..... B01D 46/02

[52] U.S. Cl. ..... 55/376; 55/492; 55/493; 55/DIG. 2; 55/DIG. 3

[58] Field of Search ..... 55/363, 369, 373–378, 55/492, 493, DIG. 2, DIG. 3, 361, 367; 15/339, 352

[56] References Cited

U.S. PATENT DOCUMENTS

| | | | |
|---|---|---|---|
| 2,771,152 | 11/1956 | Bramhall et al. | 55/363 |
| 2,870,863 | 1/1959 | Bramhall | 55/363 X |
| 3,416,721 | 12/1968 | Fesco | 55/DIG. 2 X |
| 3,417,550 | 12/1968 | Fesco | 55/DIG. 2 X |
| 4,591,369 | 5/1986 | Stewart | 55/374 |

*Primary Examiner*—Charles Hart

*Attorney, Agent, or Firm*—Mason, Kolehmainen, Rathburn & Wyss

[57] ABSTRACT

A canister vacuum cleaner includes a dust bag mount for mounting a dust bag with a collar onto the vacuum cleaner. The bag mount includes a mounting plate with a circular aperture. The dust bag collar includes an aperture that, upon installation of the collar, is aligned with the aperture in the mounting plate. Raised structure surrounds the aperture in the mounting plate and extends into the aperture in the collar upon installation providing a seal between the mounting plate and collar. The raised structure includes ramps and inclined surfaces to bend and lift the dust bag collar over the raised structure during its installation and removal. This structure also serves to index and retain the collar once it is installed and to seal the space between the installed dust bag collar and the mounting plate. A pair of channels are provided at the sides of the mounting plate for holding and guiding the edges of the dust bag collar during its installation and removal. A ramp is provided in each channel which acts to bias the dust bag collar against the mounting plate upon the installation of the dust bag. The channels are also sloped or angled relative to the mounting plate to reduce the stress imparted to the dust bag collar during its installation and removal and to move the dust bag collar against the mounting plate once the collar is installed. The dust bag collar includes a gripping tab and an aperture in the gripping tab to facilitate the removal of the dust bag collar from the bag mount.

25 Claims, 2 Drawing Sheets

10
12
14
16
18
20
22
24
26
28
30
32
34
36
38
40
42
44
45
46
48
50
52
54
56
60
62
66
68
72
74
76
82
84
86
88
94
96
4
5
6

FIG. 6
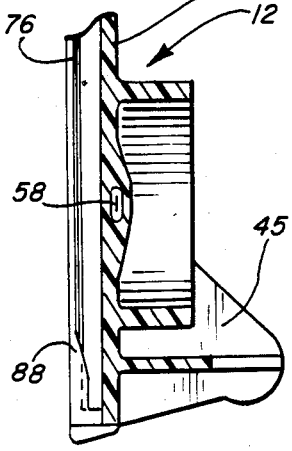
FIG. 13
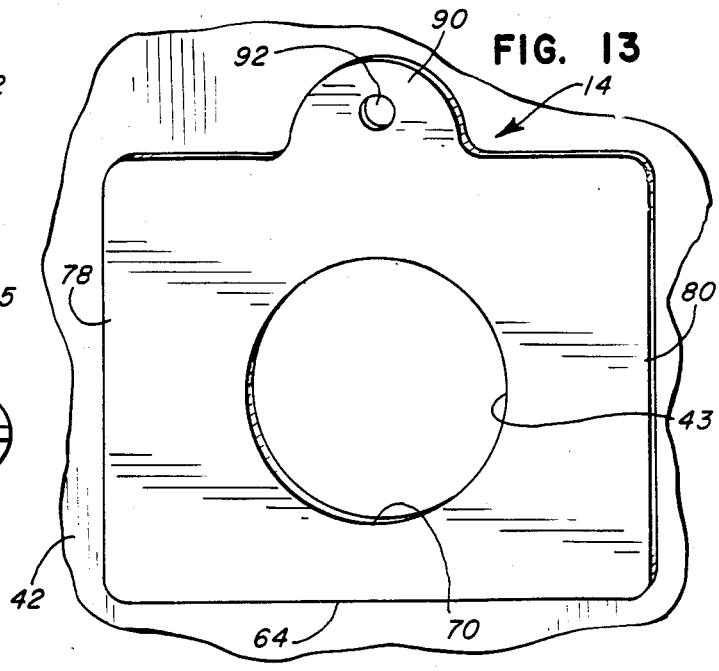
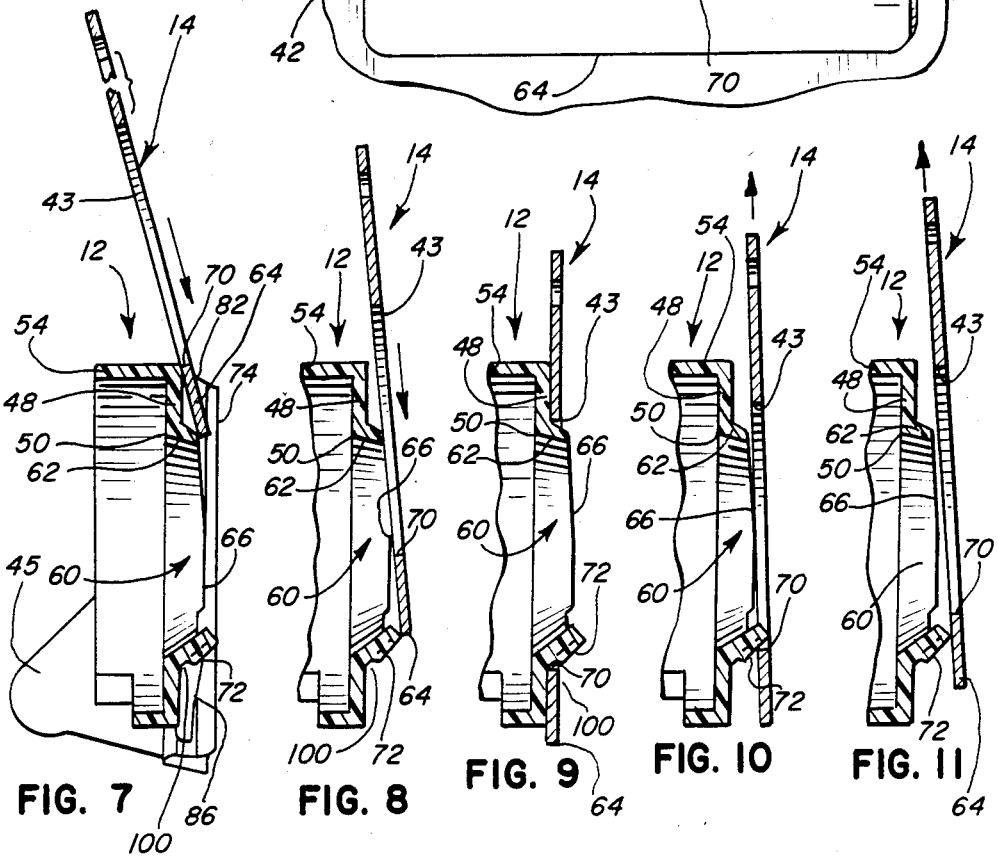

VACUUM CLEANER BAG MOUNT AND METHOD FOR MOUNTING A DUST BAG THEREON

BACKGROUND OF THE INVENTION

A. Field of the Invention

The present invention generally relates to vacuum cleaners and, more particularly, to a vacuum cleaner with a dust bag mount that allows easy installation and removal of a dust bag.

B. Description of the Prior Art

In a conventional vacuum cleaner, a dust bag for collecting dust and dirt is removably mounted in the vacuum cleaner in operative association with the air moving assembly of the vacuum cleaner. Once the dust bag is filled, it is removed and a replacement bag is installed. Examples of such vacuum cleaner structures are disclosed in U.S. Pat. Nos. 3,675,399; 3,812,659; 4,469,498; 4,554,700 and 4,591,369, all assigned to the assignee of the present invention.

A typical dust bag (sometimes also referred to as a filter bag) includes a collar with a central aperture leading to the interior of the dust bag. To install the dust bag in a vacuum cleaner, the collar is mounted on a dust bag mount provided on the vacuum cleaner. The dust bag mount includes an aperture that, upon installation of the dust bag, is aligned with the aperture in the dust bag collar to allow flow of dirt and dust into the dust bag during operation of the vacuum cleaner.

To prevent escape of dust between the dust bag mount and the dust bag collar, the dust bag mount includes a raised or upstanding flange received in the aperture of the mounting plate. The upstanding flange, while minimizing escape of dust, inhibits the quick and easy installation and removal of the dust bag collar. To install a dust bag, the operator of the vacuum cleaner must force the collar over the upstanding flange or squeeze the collar to bend it, thereby allowing passage over the flange. The installation and removal of a dust bag collar in this manner can damage the collar, resulting in an incomplete seal around the aperture of the bag mount. The force needed to be applied to the bag collar and the manipulation required to install and remove the dust bag make installation and removal difficult and frustrating for the typical user. Further adding to the difficulty of installing and removing dust bags is the lack of an effective, high friction gripping surface on the collars of dust bags.

SUMMARY OF THE INVENTION

An object of the present invention is to provide a new and improved vacuum cleaner.

Another object of the present invention is to provide a new and improved bag mount for a vacuum cleaner dust bag.

A further object of the present invention is to provide a new and improved bag mount for a vacuum cleaner that is self-indexing to facilitate easy installation and removal of a dust bag collar.

A still further object of the present invention is to provide a new and improved vacuum cleaner dust bag having a collar that provides a high friction gripping surface to facilitate the manual installation and removal of dust bags in vacuum cleaners.

Another object of the present invention is to provide a new and improved method or process of installing and removing a dust bag in a vacuum cleaner.

Briefly, the present invention constitutes a new and improved dust bag mount for a vacuum cleaner and a collar for a vacuum cleaner dust bag that facilitate the installation and the removal of dust bags in vacuum cleaners. The vacuum cleaner of the present invention includes a rotatable brush powered by a brush motor. The brush and motor are located in a floor cleaning unit remotely disposed from a receptacle. The receptacle is provided for the collection of particulate matter. The floor cleaning unit is mechanically and pneumatically interconnected to the receptacle through a wand and a wand handle and hose assembly.

The receptacle includes a space for a dust bag. Dust bags of the present invention include a dust bag collar with an aperture defining an inlet to the dust bag. The aperture in the collar pneumatically communicates with the wand handle and hose assembly through a dust bag mount having a mounting plate with an aperture. To install a dust bag in the vacuum cleaner, the collar is positioned upon the bag mount with the aperture in the collar aligned with the aperture in the mounting plate of the bag mount. To ensure a seal between the two apertures, the bag mount includes a raised structure or flange that extends into the aperture of the dust bag collar once the dust bag is installed.

The raised structure on the bag mount functions to seal the space between the apertures in the dust bag collar and the mounting plate, to index the dust bag collar during the operation of the vacuum cleaner, to facilitate installation and removal of the dust bag collar, and to prevent damage to the collar during installation and removal. The raised structure includes a first inclined surface above the aperture in the mounting plate that is engaged by the bag collar as it is installed. The inclined surface, with only a small installation force applied to the collar, gently flexes and lifts the collar relative to the mounting plate. At the sides of the aperture in the mounting plate the raised structure defines an upstanding rim that maintains the collar in an elevated position as the collar is moved further onto the bag mount. Opposite the first inclined surface, the raised structure includes a second inclined surface having a ramp and adjacent inclined sides. At the completion of installing the bag collar, the aperture in the collar moves down the ramp and the inclined sides.

Removal of the collar from the mounting plate requires pulling the collar out of the bag mount. As pulling is initiated, the aperture in the collar engages the ramp and the inclined sides. The collar is flexed and lifted relative to the mounting plate. The upstanding rim maintains the collar in the elevated position as the collar is further withdrawn avoiding interference with the raised structure and allowing the collar to be easily removed from the bag mount.

To guide the collar during installation and removal, the bag mount includes a pair of channels for guiding and holding the side edges of the collar. Each channel includes an entrance portion to reduce stress on the collar during installation. A pair of ramps are provided in the channels that bias the collar against the mounting plate at the conclusion of installation to improve the seal between the mounting plate and bag collar. Additional force tending to move the collar against the mounting plate is provided by sloping the channels relative to the mounting plate.

To install and remove the dust bag from the bag mount, the dust bag collar includes a gripping tab that may be grasped by the user of the vacuum cleaner during installation and removal. The gripping tab includes a removal assist structure in the form of an aperture that provides a high friction gripping surface, reducing the manual force required for removal of the collar.

The improved mounting plate and collar facilitate the installation and the removal of the collar without damage to the collar. Although the collar of the present invention is easily installed and removed, there is no sacrifice in the seal provided between the mounting plate and collar.

BRIEF DESCRIPTION OF THE DRAWING

The above and other objects, advantages and novel features of the present invention will become apparent from the following detailed description of the preferred embodiment of the present invention illustrated in the accompanying drawing wherein:

FIG. 6 is an enlarged, cross-sectional view taken generally along line 6—6 in FIG. 3;

FIG. 7 is a cross-sectional view showing the beginning of the installation of a dust bag collar onto the mount;

FIG. 8 is a view similar to FIG. 7 illustrating lifting and indexing the dust bag collar at a later point during installation;

FIG. 9 is a view similar to FIGS. 7 and 8 illustrating the dust bag collar at the conclusion of installation;

FIG. 10 is a view similar to FIGS. 7–9 illustrating the dust bag collar during commencement of removal of the collar;

FIG. 11 is a view similar to FIGS. 7–10 illustrating the lifting of the dust bag collar at a later point during removal of the collar;

FIG. 13 is an enlarged fragmentary front view of a dust bag having a collar constructed in accordance with the principles of the present invention.

DESCRIPTION OF THE PREFERRED EMBODIMENT

Figures 1, 2, 3, 4, 5, 12:
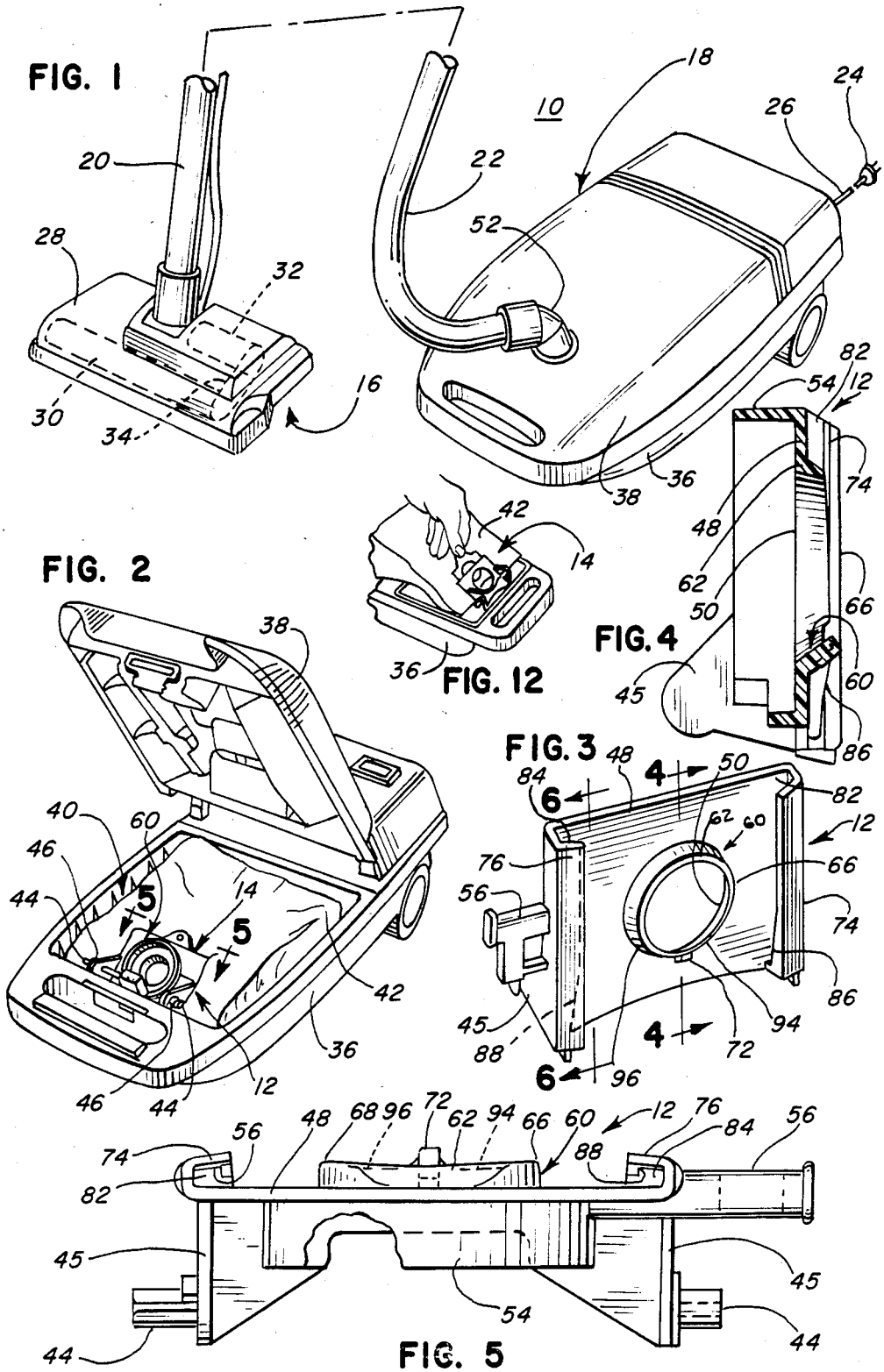
FIG. 1 depicts a vacuum cleaner, with portions broken away, constructed in accordance with the principles of the present invention.
FIG. 2 is a perspective view of the canister of the vacuum cleaner of FIG. 1 depicting a dust bag and dust bag mount constructed in accordance with the principles of the present invention.
FIG. 3 is an enlarged, perspective view of the bag mount illustrated in FIG. 2.
FIG. 4 is a vertical, cross-sectional view taken generally along line 4—4 in FIG. 3.
FIG. 5 is an enlarged, top plan view of the bag mount of the present invention taken generally from line 5—5 in FIG. 2.
FIG. 12 is a fragmentary perspective view of a portion of the vacuum cleaner during dust bag removal.

Referring to the drawing, there is illustrated a new and improved vacuum cleaner 10 (FIG. 1) having a new and improved dust bag mount 12 (FIG. 3) and a new and improved dust bag having a collar 14 (FIGS. 2 and 13). The vacuum cleaner 10 includes a floor cleaning unit in the form of a power nozzle 16 (FIG. 1) and a remotely disposed canister 18 (FIG. 1) mechanically and pneumatically interconnected by a conventional rigid wand 20 and a flexible hose 22. The vacuum cleaner 10 is powered by conventional, 110–120 volts alternating current power through an electrical plug 24 mechanically and electrically secured to a conventional, retractable, electrical power cord 26. While the preferred embodiment of the present invention is depicted herein as a canister vacuum cleaner 10, the principles of the present invention may be applicable to other types of vacuum cleaners having removable dust bags, for example, upright vacuum cleaners.

The floor cleaning unit 16 includes a power nozzle housing 28 containing a rotatable brush 30 and an electrical, alternating current brush motor 32 for rotating the brush 30 through a conventional belt drive assembly 34. The canister 18 includes a base 36 to which is mounted a fan and motor (not shown) and a cord reel (not shown) and a hood 38 pivotally mounted to the base 36 for selective movement between a closed disposition (FIG. 1) and an open disposition (FIG. 2). When disposed in the open position, the hood 38 provides access to a dust collecting space 40 within the base 36 adapted to receive a dust bag 42.

The dust bag mount 12 of vacuum cleaner 10 is mounted to the base 36 and serves to removably mount the dust bag 42. The specific mounting arrangement of the dust bag mount 12 in the vacuum cleaner 10 may be understood by reference to U.S. Pat. No. 4,591,369, assigned to the assignee of the present invention and herein incorporated by reference. The dust bag 42 includes an inlet secured to the dust bag collar 14. The bag mount 12 includes a pair of pivot posts 44 (FIG. 5) formed on a pair of spaced-apart brackets 45 received in suitable pivot supports 46 formed integrally with the base 36. A mounting plate 48 has a central aperture 50 formed through its planar surface for removably receiving a suction hose connector 52 (FIG. 1). In the preferred embodiment, the aperture 50 is circular. An annular seal (not shown) may be mounted coaxially of the aperture 50 by a mounting ring 54.

The dust bag mount 12 also includes an air passage member 56 in communication with an opening 58 (FIG. 6) in the mounting plate 48 at the aperture 50. The air passage member 56 enables changes in the air pressure sensed at the opening 58 to be sensed by a pressure sensitive switch (not shown).

The dust bag collar 14 is preferably flat and of a flexible, inexpensive material such as cardboard. The collar 14 is attached or bonded to the dust bag 42, such as by glue; and the aperture 43 is aligned with an opening in the dust bag 42. The collar 14 and the bond between the collar 14 and the dust bag 42 can be damaged if flexing during installation and removal is not controlled. The bag mount 12 controls the flexing of the collar 14 and prevents damage.

When the collar 14 is installed on the bag mount 12, an aperture 43 of the collar 14 is aligned with the aperture 50 in the mounting plate 48. In the past, installing and removing a dust bag collar was difficult because an outwardly projecting flange surrounded the aperture in conventional mounting plates. This outwardly projecting flange was adapted to be received in the dust bag collar for retaining the collar in a generally sealed association with the bag mount. During installation, however, the leading bottom edge of the collar engaged the flange; and the collar had to be bent or twisted to get the collar over the flange. During removal, the bottom edge of the aperture in the collar engaged the flange, requiring further bending and twisting of the collar and the application of considerable force to allow removal. This bending and twisting, unless carefully performed, could damage the collar and impair the seal between the collar and the bag mount.

To overcome the problems arising from the engagement of the collar with the flange in a conventional bag mount, the bag mount 12 of the present invention includes a multiple angled, inclined ramp surface 60 surrounding the aperture 50 to effectuate self-indexing of the collar 14 of the dust bag 42 about the aperture 50 during a dust bag installation procedure. The self-indexing is achieved in the following manner. The ramp surface 60 includes an inclined entry ramp 62 engaged by the lower leading edge 64 of the collar 14 during the initial step of installing the collar 14 (FIG. 7). The smooth upward slope or incline of the ramp 62 automatically gently flexes and bends the collar 14 upwardly relative to the mounting plate 48 as the collar 14 is pushed into the bag mount 12. Due to the inclined, cam-like surface of the ramp 62, only slight resistance is experienced during the installation of the collar 14.

The ramp surface 60 also includes a pair of spaced-apart rims 66 and 68. As the collar 14 is pushed further into the bag mount 12, the rims 66 and 68, which are spaced above the surface of the mounting plate 48 and on opposite sides of the aperture 50, engage the collar 14 and maintain the collar 14 in an elevated position and in a flexed condition relative to the mounting plate 48 (FIG. 8). At the conclusion of the installation of the collar 14, the lower edge 70 of the aperture 43 slides down a ramp 72 formed on the lower portion of the multiple angled ramp surface 60 to the fully installed position (FIG. 9). In the fully installed position, the ramp 62, the rims 66 and 68 and the ramp 72 define a circular retention area around which the aperture 43 fits to retain the collar 14.

During installation, the collar 14 is guided and moved against mounting plate 48 by a pair of spaced-apart, inwardly directed channels 74 and 76. The channels 74 and 76 cooperate with the ramp surface 60 to provide for the controlled flexing of the collar 14 with minimum force being applied to the collar 14 during its installation and removal. This controlled flexing minimizes the possibility of damage to the collar 14, such as permanent deformation. The channels 74 and 76 receive a pair of spaced-apart lateral edges 78 and 80 of the collar 14. The entrances 82 and 84 of the channels 74 and 76, respectively, are increased in wall thickness and are shaped to guide the entry of the collar 14 and reduce the stress on the collar 14 during its installation.

As illustrated in FIG. 5, the channels 74 and 76 are not formed parallel to the surfaces of the mounting plate 48 but, rather, are formed at an angle or slope "X" to the mounting plate 48. This angle or channel slope "X" permits the collar 14 to bend without imposing undue stress on the collar 14 during its installation and removal. Once the collar 14 is installed, however, the angle or slope "X" of the channels 74 and 76 causes the collar 14 to be pressed against the mounting plate 48, improving the seal between the collar 14 and the bag mounting plate 48. The slope "X" of the channels 74 and 76 also reduces the material bulk in the corners of the dust bag mount 12, reducing the stress on the collar 14.

It is preferred to provide the best seal possible between the collar 14 and the mounting plate 48 during operation of the vacuum cleaner 10. In addition to the slope "X" of the channels 74 and 76, further pressure for biasing the collar 14 against the mounting plate 48 is provided by a pair of spaced-apart ramps 86 and 88 at the lower ends of the channels 74 and 76, respectively. During the final phase of installation (FIG. 9), the lower ends of the sides 78 and 80 adjacent the edge 64 of the collar 14 engage the ramps 86 and 88, biasing the collar 14 against the mounting plate 48 to enhance the seal between the mounting plate 48 and the collar 14. The ramp 72 is formed to stop short of the mounting plate 48 to provide a recess 100 (FIGS. 7, 8 and 9) which captures the lower edge 70 of the collar 14 in the fully installed position (FIG. 9) of the dust bag 42. Thus, in the fully installed position, the dust bag 42 is in a secure disposition on the bag mount 12 due to the "lock" provided by recess 100 and channels 74 and 76.

When the dust bag 42 is to be removed, the user of the vacuum cleaner 10 merely grabs the collar 14 and applies a pulling force (FIG. 12). To allow the collar 14 to be grasped easily and to minimize the manual force required to be applied to collar 14 for removal, the collar 14 includes a tab 90 with a small hole 92. Preferably, the hole 92 is purposely formed as a small hole 92 to provide a gripping surface rather than an insertion medium on the otherwise relatively smooth planar surface of the tab 90. The diameter of the hole may be in the range of from approximately 0.125 inch to approximately 0.375 inch, and specifically may be approximately 0.250 inch, i.e., less than the diameter of a finger of the operator of the vacuum cleaner 10 to minimize the possibility of tearing the tab 90 when it is grabbed by the operator. The hole 92 provides a high friction gripping surface, thereby reducing the manual force required to be applied on the tab 90. Without the small hole 92, the relatively smooth surface of the tab 90 would exhibit a relatively low coefficient of friction, requiring the application of a correspondingly greater amount of operator force to remove the collar 14. The tab 90 also provides a gripping surface during the installation of the collar 14. Also, grasping the collar 14 at the tab 90 during the installation of the collar 14 ensures that the insertion force is applied at the center of the collar 14, thereby requiring only a simple push during the last stage of installation. The hole 92 is shown as round in shape, however, it could be of another suitable shape adapted to provide an improved finger gripping surface such as a rectangular shape or a star shape. Also, the collar 14 could be indented, or have a raised portion, or other discontinuity in the finger gripping zone of said collar to provide an improved finger gripping surface to assist and facilitate dust bag installation and removal.

During the initial stage of removing the collar 14, the lower edge 70 of the aperture 43 engages the ramp 72 and a pair of spaced-apart surfaces 66, 68 disposed adjacent the ramp 72. The ramp 72 and the surfaces 66, 68 act in conjunction to flex the bag collar 14, thereby raising the collar 14 relative to the surface of the mounting plate 48 (FIG. 10). The incline or slope of the ramp 72 and the surfaces 66 and 68 provide a cam effect so that only a small pulling force is required to be applied to the collar 14 to initiate its removal. The curvilinear surfaces 94 and 96 provide clearance to facilitate the removal movement of the collar as it initially bows and rides up the lower portion of the ramp 72 with vertical movement relative to the dust bag mount 12. As the removal process is continued, the rims 66 and 68 continue to maintain the collar 14 in an elevated position, allowing the collar 14 to pass over the multiple angled ramp surface 60 (FIG. 11). The ramp 62, the rims 66 and 68, and the curvilinear rim segment 94 and 96 act in conjunction with the ramp 72 to define an oval surface or opening that imparts a direct vertical lift force to the collar 14 for facilitating its installation, for automatic indexing of the collar 14 about the surface 60 during operation of the vacuum cleaner 10 and for facilitating the eventual removal of the collar 14.

Many modifications and variations of the present invention are possible in light of the above teachings. For example, the generally oval shape of the surface or opening formed above the planar surface of the mounting plate 48 could be made circular, in which case the shape of the aperture 43 in the collar 14 would preferably be made oval. Thus, it is to be understood that, within the scope of the appended claims, the invention may be practiced otherwise than as specifically described.

What is claimed and desired to be secured by Letters Patent is:

1. A self-indexing bag mount for an apertured dust bag collar secured to a dust bag for use in a vacuum cleaner comprising a mounting plate having a generally planar surface, an aperture through said mounting plate, first means adjacent said aperture for moving the dust bag collar away from said planar surface of said mounting plate and over said aperture during installation of said dust bag collar onto said bag mount, said first means including an inclined ramp surface formed on said mounting plate and configured to engage an edge of said dust bag collar during the installation of said dust bag in said vacuum cleaner to move said collar away from said planar surface.

2. A self-indexing bag mount as set forth in claim 1 wherein said aperture is circular.

3. A self-indexing bag mount as set forth in claim 1 further comprising second means on said mounting plate disposed at least partially around the periphery of said aperture for maintaining said dust bag in a raised position relative to said mounting plate subsequent to said lifting of said dust bag collar.

4. A self-indexing bag mount as set forth in claim 3 wherein said second means includes an upstanding rim.

5. A self-indexing bag mount as set forth in claim 1 further comprising third means adjacent said aperture for moving said dust bag collar away from said mounting plate during the removal of said dust bag collar from said bag mount.

6. A self-indexing bag mount as set forth in claim 5 wherein said third means includes a second inclined ramp surface formed on said mounting plate.

7. A self-indexing bag mount as set forth in claim 5 further comprising an inclined surface on opposite sides of said third means coacting with said third means for bending and lifting said dust bag collar during the removal of said dust bag collar from said mounting plate.

8. A self-indexing bag mount as set forth in claim 1 further comprising a rim at least partially surrounding said aperture, said first means and said rim defining an oval collar lifting and indexing surface.

9. A self-indexing bag mount as set forth in claim 1 further comprising at least one channel on said mounting plate for guiding the movement of said dust bag collar during its installation and removal.

10. A self-indexing bag mount as set forth in claim 1 further comprising at least one channel on said mounting plate for guiding said dust bag collar during its installation and removal and means disposed in said channel for engaging said dust bag collar and for moving said dust bag collar against said mounting plate.

11. A self-indexing bag mount as set forth in claim 1 further comprising at least one channel on said mounting plate for guiding said dust bag collar during installation and removal, said channel including an entrance having means for reducing stress on said dust bag collar.

12. A self-indexing bag mount as set forth in claim 1 further comprising at least one channel on said mounting plate for guiding said dust bag collar during its installation and removal, said channel being oriented at an angle relative to said mounting plate.

13. A self-indexing bag mount as set forth in claim 1 further including an oval aperture formed above said mounting plate.

14. A self-indexing bag mount as set forth in claim 1 further including means for pivotally mounting said bag mount in said vacuum cleaner.

15. A self-indexing bag mount for a vacuum cleaner dust bag wherein said dust bag includes a generally planar, flexible dust bag collar with an aperture comprising a mounting plate, an aperture in said mounting plate, a first ramp surface on said mounting plate engageable with an edge of the collar for lifting and flexing said dust bag collar during the installation of said dust bag collar onto said mounting plate, a rim extending from said first ramp surface and at least partially surrounding said aperture in said mounting plate and a second ramp surface adjacent said aperture in said mounting plate engageable with the aperture in the collar for flexing and forming said dust bag collar during the removal of said dust bag collar from said mounting plate.

16. A self-indexing bag mount as claimed in claim 15 wherein said second ramp surface, said first ramp surface, said rim and said ramp define a dust bag collar retention area, said aperture of said dust bag collar being circular.

17. A self-indexing bag mount as claimed in claim 15 wherein said second ramp surface includes at least one inclined surface, said first ramp surface, said rim and said at least one inclined surface defining an oval lifting surface for applying a vertical lifting force on said dust bag collar.

18. A self-indexing bag mount as claimed in claim 15 further comprising at least one guide means on said mounting plate for holding and guiding said dust bag collar during insertion and removal of said dust bag collar.

19. A self-indexing bag mount as claimed in claim 18 further comprising ramp means in said guide means for moving said dust bag collar against said mounting plate.

20. A vacuum cleaner dust bag comprising means for receiving and retaining debris and means for mounting said dust bag in a vacuum cleaner, said mounting means including means for reducing the force required to install said dust bag in or remove said dust bag from a vacuum cleaner, said force reducing means comprising aperture means formed through said mounting means for providing a high friction gripping surface for manual engagement by a human operator during the installation of said dust bag in or removal of said dust bag from a vacuum cleaner, said aperture means being configured to minimize the possibility of the insertion therethrough of a finger of a human operator of a vacuum cleaner.

21. A vacuum cleaner dust bag as recited in claim 20 wherein said aperture means comprises an aperture having a dimension across the opening of said aperture in the range of from approximately 0.125 inch to approximately 0.375 inch.

22. A vacuum cleaner dust bag as recited in claim 21 wherein said dimension is approximately 0.250 inch.

23. A vaccuum cleaner cleaner dust bag comprising means for receiving and retaining debris and means for manually mounting said dust bag in a vacuum cleaner, said mounting means comprising a collar attached to said dust bag, said collar including means for reducing the force required to install said dust bag in or remove said dust bag from a vacuum cleaner, said force reducing means comprising a high friction discontinuity formed in a finger gripping zone of said collar, said discontinuity being configured to minimize the possibility of the insertion of a finger of a human operator of a vacuum cleaner through the collar at the location of said discontinuity.

24. A new use of an aperture formed through a collar of a vacuum cleaner dust bag, said aperture being configured to minimize the possibility of the insertion therethrough of a finger of a human operator of a vacuum cleaner, said new use comprising the step of manually gripping said collar at the location of said aperature during the removal of said dust bag from a vacuum cleaner to facilitate the removal of said dust bag from a vacuum cleaner.

25. A new use of an aperture formed through a collar of a vacuum cleaner dust bag as recited in claim 24 further comprising the step of manually gripping said collar at the location of said aperture during the installation of said dust bag in a vacuum cleaner to facilitate the installation of said dust bag in a vacuum cleaner.

* * * * *

UNITED STATES PATENT AND TRADEMARK OFFICE

CERTIFICATE OF CORRECTION

PATENT NO. : 4,738,697

DATED : 19 April 1988

INVENTOR(S) : WESTERGREN

It is certified that error appears in the above-identified patent and that said Letters Patent is hereby corrected as shown below:

Column 8, line 64, after "or", "the" should be inserted;

Column 9, line 8, preceding "dust", "cleaner" should be deleted.

Signed and Sealed this

Seventeenth Day of January, 1989

*Attest:*

DONALD J. QUIGG

*Attesting Officer*

*Commissioner of Patents and Trademarks*